US007766700B2

(12) United States Patent
Ho

(10) Patent No.: US 7,766,700 B2
(45) Date of Patent: Aug. 3, 2010

(54) ELECTRICAL CONNECTOR

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,691

(22) Filed: Sep. 23, 2008

(65) Prior Publication Data

US 2010/0075542 A1 Mar. 25, 2010

(51) Int. Cl.
*H01R 24/00* (2006.01)

(52) U.S. Cl. ..... 439/660; 439/607.1

(58) Field of Classification Search ..... 439/660, 439/752, 943, 733.1
See application file for complete search history.

(56) References Cited

U.S. PATENT DOCUMENTS 5,338,220 A * 8/1994 Soes et al. ..... 439/403
6,193,552 B1 * 2/2001 Chiou et al. ..... 439/607.35
7,329,154 B2 * 2/2008 Koyama ..... 439/660
7,465,194 B1 * 12/2008 Ho et al. ..... 439/607.01

* cited by examiner

*Primary Examiner*—Renee Luebke
*Assistant Examiner*—Larisa Tsukerman
(74) *Attorney, Agent, or Firm*—Rosenberg, Klein & Lee

(57) ABSTRACT

An electrical connector includes an insulating housing, a plurality of terminals fixed in the insulating housing and a shell mated with the insulating housing. The insulating housing has a base portion and a mating portion extending from a front surface of the base portion. The mating portion defines a plurality of terminal grooves penetrating through a rear surface of the base portion. Each terminal has a fixed portion received in the corresponding terminal groove and two shoulder portions respectively projecting sideward from two opposite sides of one end of the fixed portion. The base portion defines a receiving trough communicate rear ends of the terminal grooves and outside of the base portion for receiving the shoulder portions. Thus, the terminals can be assembled to the insulating housing conveniently and rapidly during using a tool to push the shoulder portions to insert the terminals into the terminal grooves.

12 Claims, 7 Drawing Sheets

ELECTRICAL CONNECTOR

BACKGROUND OF THE INVENTION

1. Field of the Invention

The present invention relates to an electrical connector, and more particularly to an electrical connector capable of being assembled easily.

2. The Related Art

Conventionally, a known electrical connector includes an insulating housing defining a plurality of terminal grooves each of which has a terminal fixed therein. The terminal has a fixed portion, one end of the fixed portion defines an elastic contacting portion and the other end has a welded portion extending therefrom and two shoulder portions respectively projecting outward from two opposite sides thereof. Two opposing sides of one end of the terminal groove respectively extend sideward to form a containing cavity for receiving the shoulder portions therein.

However, considering the miniaturization trend of the electrical connector or an increase in the amount of the terminals, the amount of the terminal grooves should also be increased to correspond to the terminals. So an interval between two neighboring terminal grooves became narrower, and more obviously to two adjacent containing cavities, this will add the difficulty in manufacturing the insulating housing. Besides, during using a tool to push the shoulder portions of the terminal to insert the terminal into the terminal groove, it is easy to cause an unsteady location of the terminal because the shoulder portions are not enough wide and the tool can not provide an even force to the shoulder portions.

SUMMARY OF THE INVENTION

An object of the present invention is to provide an electrical connector capable of being assembled easily. The electrical connector includes an insulating housing, a plurality of terminals fixed in the insulating housing and a shell mated with the insulating housing. The insulating housing has a base portion and a mating portion extending from a front surface of the base portion. The mating portion defines a plurality of terminal grooves penetrating through a rear surface of the base portion. The base portion defines a receiving trough communicating rear ends of the terminal grooves and outside of the base portion. Each terminal has a fixed portion received in the corresponding terminal groove and two shoulder portions respectively projecting sideward from two opposite sides of one end of the fixed portion. When the terminals are assembled to the insulating housing, a tool is used to push the shoulder portions to insert the terminals into the corresponding terminal grooves and then the shoulder portions are received in the receiving trough.

As described above, by disposing the receiving trough communicating the rear ends of the terminal grooves to receive the shoulder portions of the terminals, the shoulder portions can be changed wider to facilitate the tool to provide a uniform pressure to push the terminals enter the terminal grooves during the terminals being assembled to the insulating housing. Thus, the terminals are assembled to the insulating housing more conveniently and rapidly and fixed in the terminal grooves more firmly.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
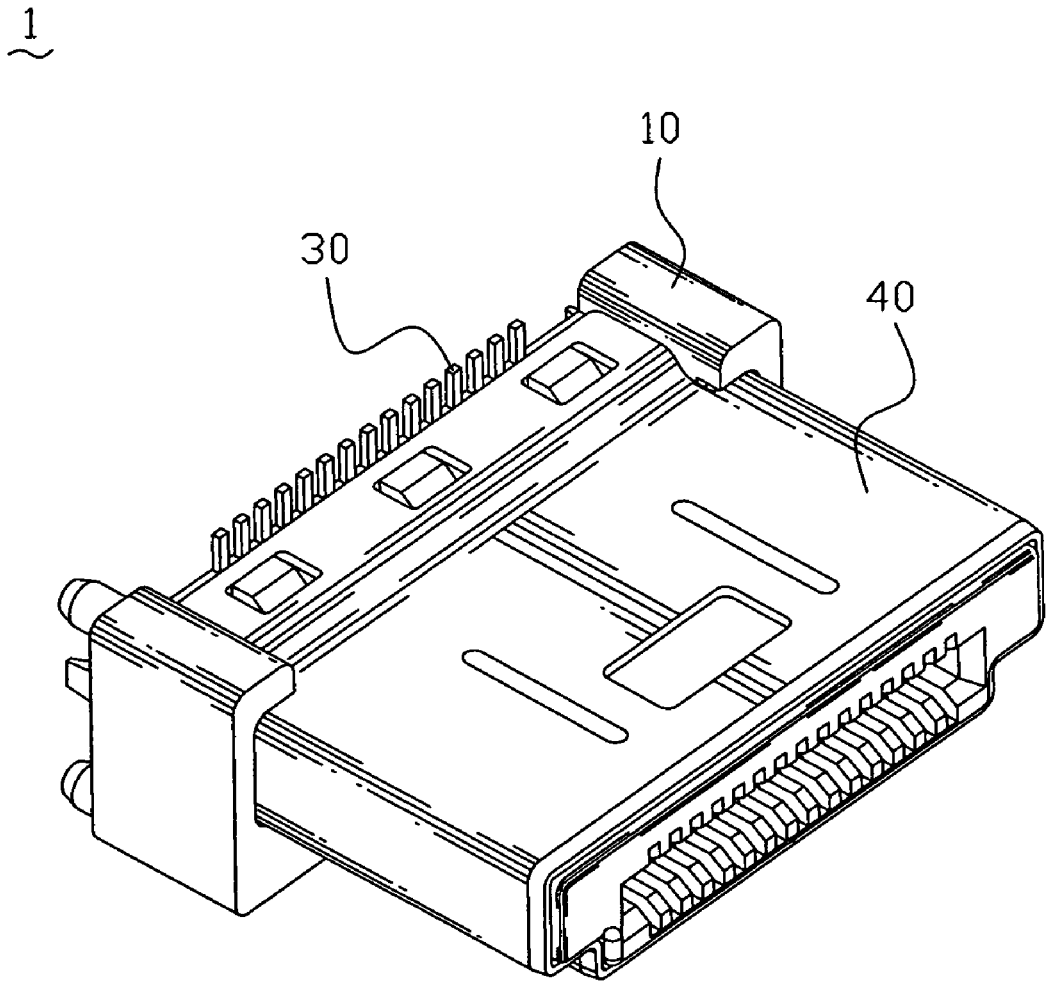
FIG. 1 is a perspective view of an electrical connector in accordance with the present invention.
Figure 2:
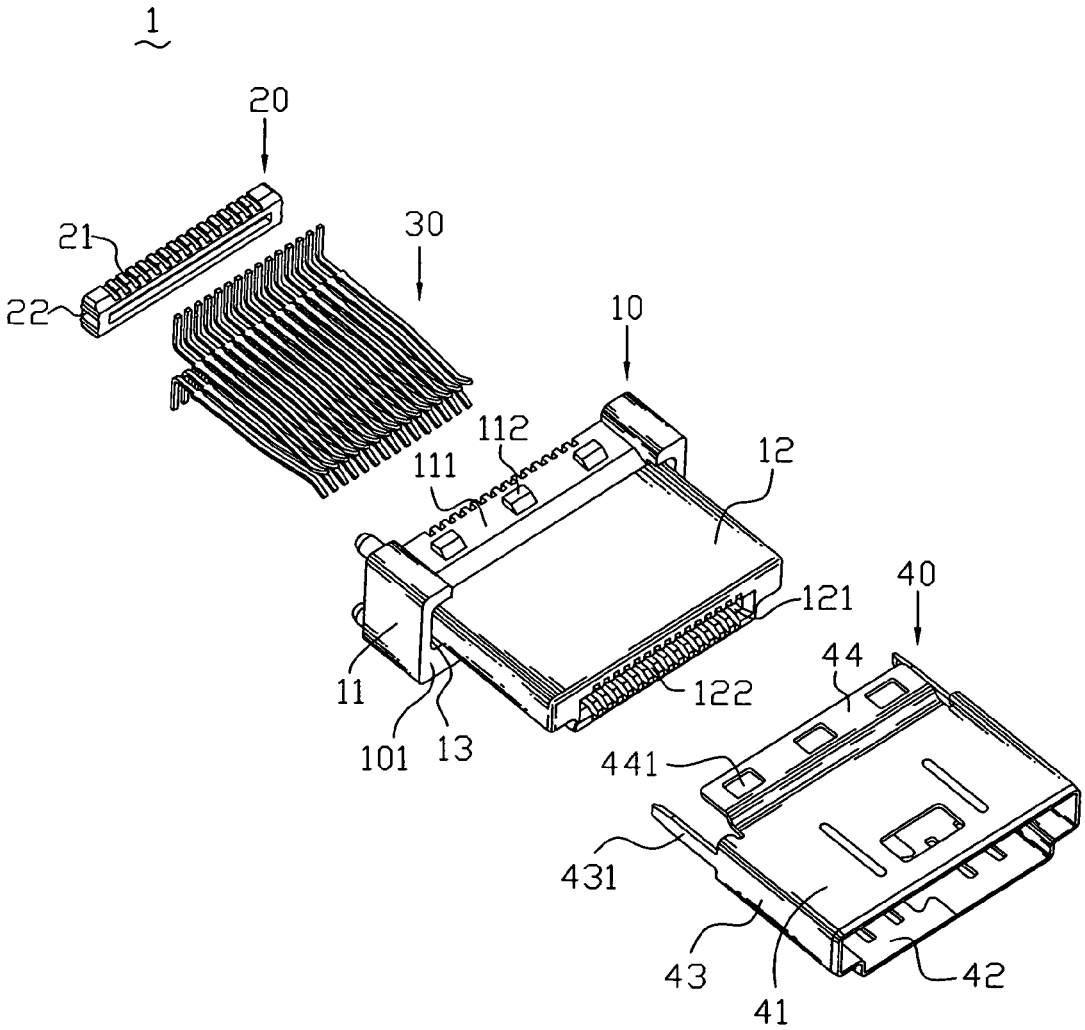
FIG. 2 is an exploded view of the electrical connector.
Figure 3:
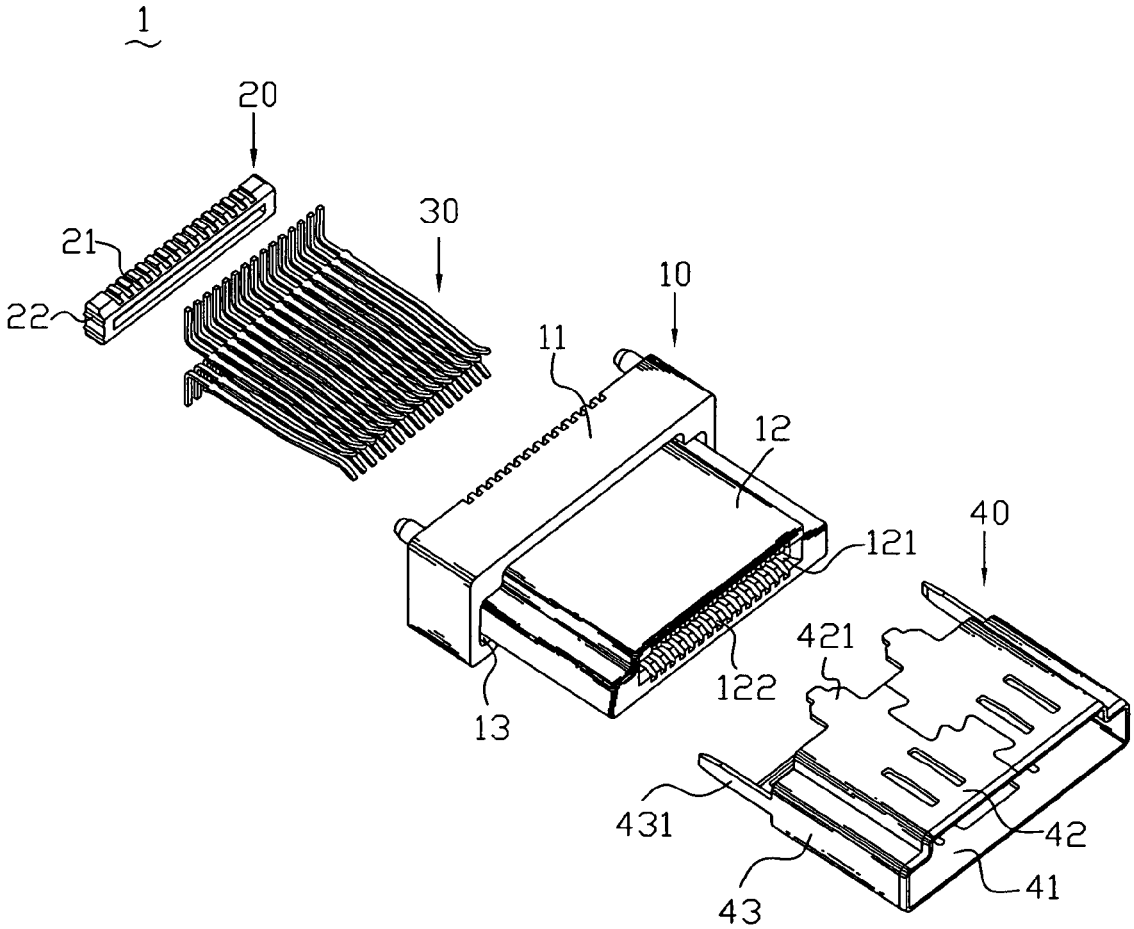
FIG. 3 is an exploded view of the electrical connector taken from an opposite angle of FIG. 2.

With reference to FIGS. 1 to 3, an electrical connector 1 according to the invention includes an insulating housing 10, a holding cover 20, a plurality of terminals 30 and a shell 40.

Figure 4:
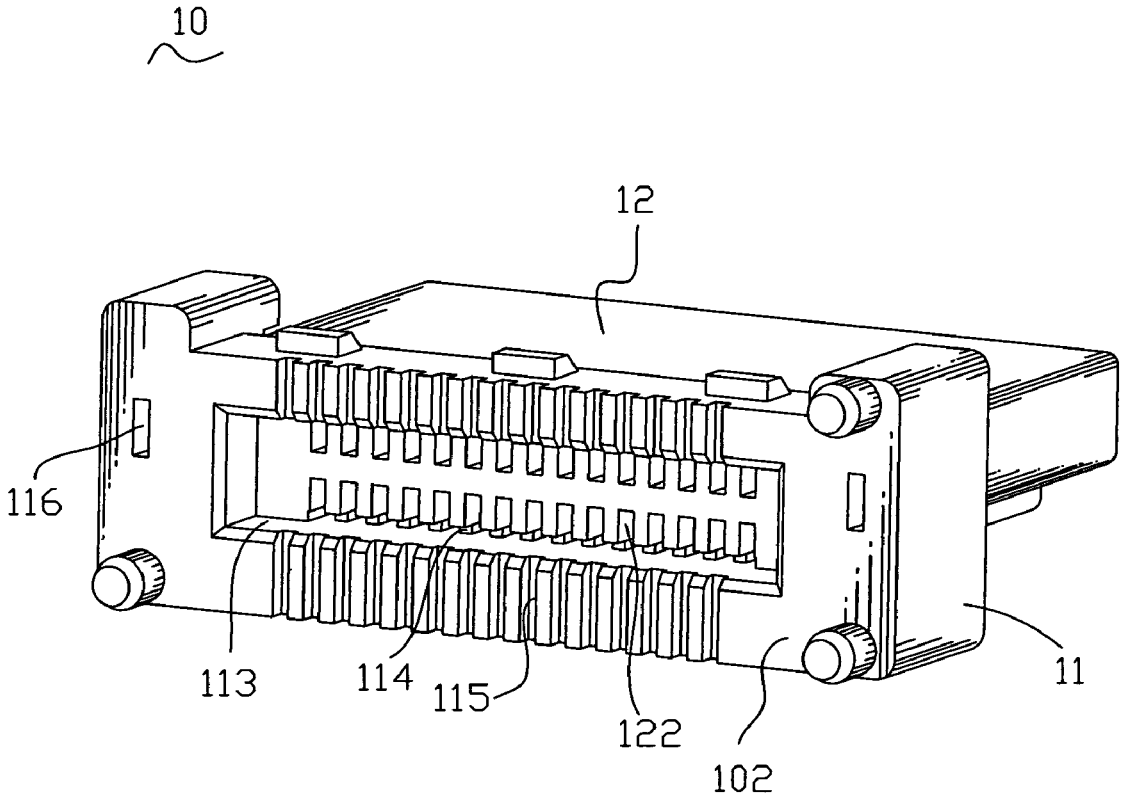
FIG. 4 is a perspective view of an insulating housing of the electrical connector.
Figure 7:
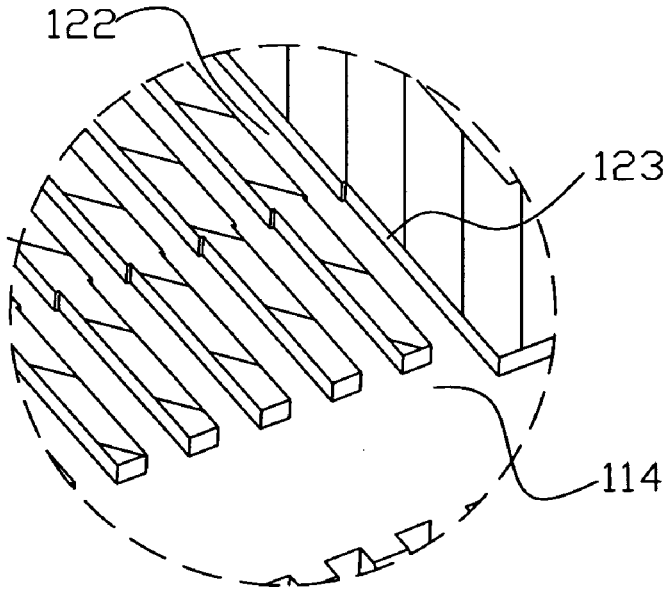
FIG. 7 is a partial enlarged view labeled IX shown in FIG. 6.
Figure 8:
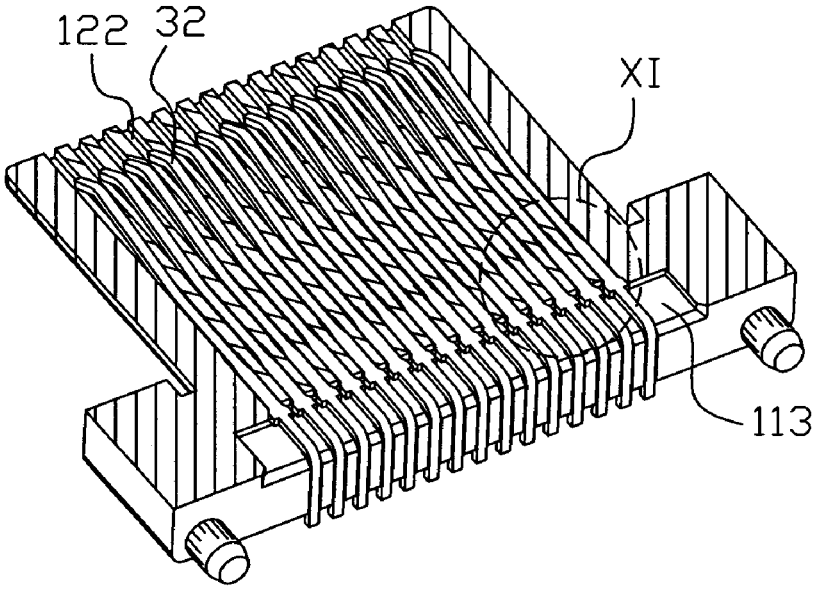
FIG. 8 is cross-sectional view showing the terminals assembled to the insulating housing.
Figure 9:
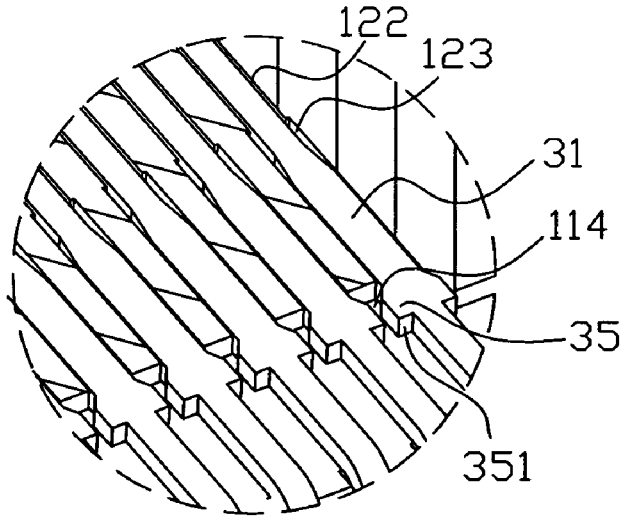
FIG. 9 is a partial enlarged view labeled XI shown in FIG. 8.

The insulating housing 10 has a substantially rectangular base portion 11 which defines a front surface 101 and a rear surface 102 (see FIG. 4) opposite to the front surface 101. A mating portion 12 extends from the front surface 101 of the base portion 11. A substantially annular receiving cavity 13 is formed in the front surface 101 of the base portion 11 to around the mating portion 12 for allowing the shell 40 to be partly inserted thereinto. The base portion 11 defines two through slots 116 (as shown in FIG. 4) penetrating therethrough and two insertion cavities (not labeled) in the receiving cavity 13. The two through-slots 116 are respectively adjacent to two opposite sides of the mating portion 12 and the insertion cavities are positioned below the mating portion 12. The mating portion 12 defines a containing chamber 121 therein. A top and a bottom side of the containing chamber 121 respectively define a plurality of terminal grooves 122 extending front-to-rear. A rear portion of each terminal groove 122 extends sideward slightly to form a fixing trough 123 (as shown in FIG. 7).

A top surface of the base portion 11 defines an opening 111 penetrating therethrough and plural substantially wedge-shaped lumps 112 abreast projecting upwardly from a bottom of the opening 111. As best shown in FIG. 4, a receiving recess 113 is transversely defined in the rear surface 102 of the base portion 11 and communicates rear ends of the terminal grooves 122 for receiving the holding cover 20 therein. The base portion 11 defines two parallel receiving troughs 114 communicating the rear ends of the terminal grooves 122. The two receiving troughs 114 are located in front of the receiving recess 113 and respectively communicate a bottom portion and a top portion of the receiving recess 113. Corresponding to the terminal grooves 122, the rear surface 102 of the base portion 11 further defines a plurality of fixing passageways 115 perpendicular to the terminal grooves 122 and the receiving recess 113 and communicating with the receiving recess 113.

The holding cover 20 shows a substantially cuboid shape. A top and a bottom surface of the holding cover 20 respectively defines a plurality of holding channels 21 penetrating therethrough. Two opposite sides of the holding cover 20 respectively defines two projecting thorns 22 protruding outside.

Figure 5:
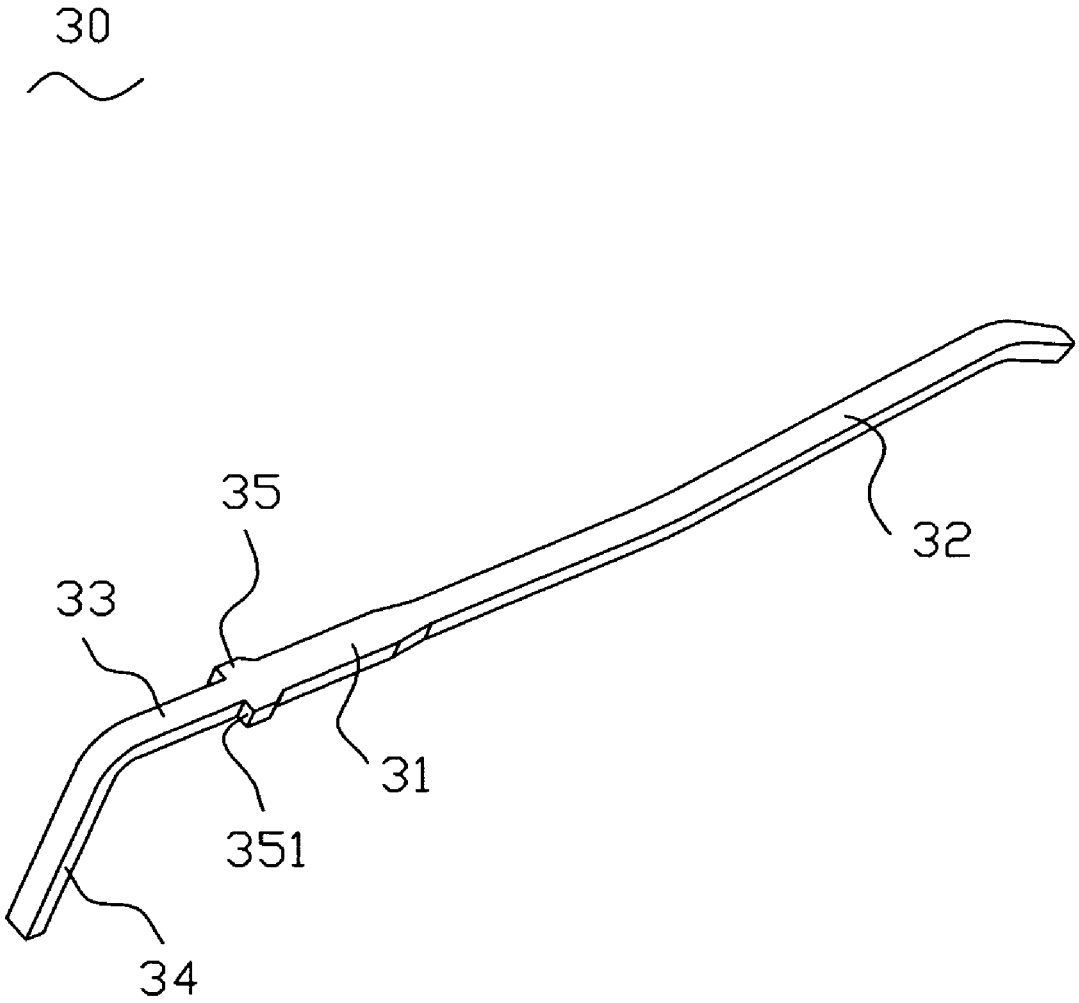
FIG. 5 is a perspective view showing a terminal of the electrical connector.
Figure 6:
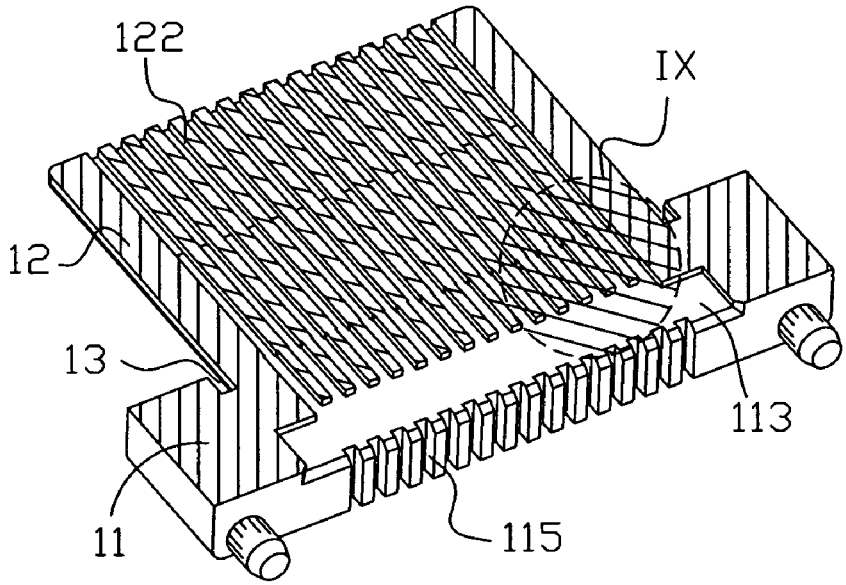
FIG. 6 is cross-sectional view of the insulating housing shown in FIG. 4.

Please refer to FIG. 5 together, each of the terminals 30 has a fixed portion 31. An elongated contacting portion 32 extends from one end of the fixed portion 31 and a free end of the contacting portion 32 slightly tilts upward and then slants downward to form a substantial arc structure. The other end of the fixed portion 31 defines an extending portion 33 extending opposite to the contacting portion 32, and a free end of the extending portion 33 bends downward to form a welded portion 34. Two opposite sides of the end which has the extending portion 33 extending therefrom of the fixed portion 31 respectively project sideward to form a shoulder portion 35. Each shoulder portion 35 has a butt surface 351 facing to the extending portion 33.

The shell 40 has a top plate 41, a bottom plate 42, and two opposing side plates 43 connecting the top plate 41 with the bottom plate 42, which corporately define a receiving space for receiving the mating portion 12 of the insulating housing 10 therein. The top plate 41 has a mantle plate 44 extending rearward from a rear end thereof, and the mantle plate 44 defines plural location holes 441 for locating the wedge-shaped lumps 112 of the insulating housing 10. A rear end of the bottom plate 42 defines two inserting plates 421 extending rearward. Each of the side plates 43 respectively defines an extending arm 431 extending towards the same direction as the inserting plates 421.

Refer to FIGS. 6-9, in assembly, the plurality of terminals 30 are divided into two groups, one group is inversely disposed beneath the other group to be assembled to the insulating housing 10. A tool is used to clip the extending portion 33 of the terminal 30 and acts on the butt surfaces 351 of the shoulder portion 35 to push the terminal 30 enter the terminal groove 122 until the welded portion 34 is fixed in the fixing passageway 115. In this case, the contacting portion 32 is received in the terminal groove 122 with the free end thereof projected out of the terminal groove 122 for electrically connecting with a complementary connector. The fixed portion 31 is received in the fixing trough 123. The shoulder portion 35 is located in the receiving trough 114 and the extending portion 33 is placed on a bottom side or a top side of the receiving recess 113.

Refer to FIGS. 1-4 again, after all the terminals 30 are assembled to the insulating housing 10, the holding cover 20 is received in the receiving recess 113 of the insulating housing 10 for holding the terminals 30. The extending portions 33 of the terminals 30 are correspondingly engaged into the holding channels 21 of the holding cover 20. The projecting thorns 22 tightly press against two opposing sides of the receiving recess 113 for fixing the holding cover 20 to the receiving recess 113. Then the shell 40 is mated with the mating portion 12 of the insulating housing 10 and partially received in the receiving cavity 13. The mantle plate 44 is disposed in the opening 111 while the wedge-shaped lumps 112 are buckled into the location holes 441. The inserting plates 421 are plugged into the corresponding insertion cavities. The extending arms 431 pass through the through slots 116 and extend out of the base portion 11 of the insulating housing 10.

As the above description, by disposing the receiving troughs 114 communicating the rear ends of the terminal grooves 122 to receive the shoulder portions 35 of the terminals 30, when the terminals 30 are assembled to the insulating housing 10, the butt surfaces 351 of the shoulder portions 35 can be changed wider to facilitate the tool to uniformly provide a stronger pressure to the butt surfaces 351 and push the terminals 30 enter the terminal grooves 122. Thus, the terminals 30 are assembled to the insulating housing 10 more conveniently and rapidly and fixed in the terminal grooves 122 more firmly.

Furthermore, the receiving troughs 114 are defined communicating the rear ends of the terminal grooves 122, it is more facile to shape the insulating housing 10. And, the tool can be accordingly enlarged accompanying with wider shoulder portions 35, so the tool is more prone to be manufactured.

What is claimed is:

1. An electrical connector, comprising:

an insulating housing having a base portion and a mating portion extending from a front surface of the base portion, the mating portion defining a plurality of terminal grooves penetrating through a rear surface of the base portion, the base portion defining a receiving trough communicating rear ends of the terminal grooves and outside of the base portion, the rear surface of the base portion defines a receiving recess communicating the rear ends of the terminal grooves for receiving a holding cover therein, the receiving trough being located in front of the receiving recess and communicating a bottom portion of the receiving recess; and a plurality of terminals fixed in insulating housing, each of the terminals having a fixed portion received in the terminal groove, two shoulder portions respectively projecting sideward from two opposite sides of one end of the fixed portion and being received in the receiving trough.

2. The electrical connector as claimed in claim 1, wherein the other end of the fixed portion has a contacting portion extending therefrom and received in the terminal groove, a free end of the contacting portion projecting out of the terminal groove for electrically contacting a complementary connector.

3. The electrical connector as claimed in claim 1, wherein two opposite sides of the holding cover respectively define at least one projecting thorn pressing against two opposing sides of the receiving recess for fixing the holding cover in the receiving recess.

4. The electrical connector as claimed in claim 1, wherein the end of the fixed portion of the terminal extends to form an extending portion, the extending portion being placed on a bottom side of the receiving recess.

5. The electrical connector as claimed in claim 4, wherein a free end of the extending portion of the terminal is bent to form a welded portion, the rear surface of the base portion defining a plurality of fixing passageways extending substantially perpendicularly to the terminal grooves and the receiving recess and communicating the receiving recess for correspondingly fixing the welded portions of the terminals.

6. The electrical connector as claimed in claim 4, wherein the holding cover defines a plurality of holding channels for correspondingly receiving the extending portions of the terminals therein.

7. An electrical connector, comprising:

an insulating housing having a base portion and a mating portion extending from a front surface of the base portion, the mating portion defining a plurality of terminal grooves penetrating through a rear surface of the base portion, the base portion defining a receiving trough communicating with rear ends of the terminal grooves and penetrating through the rear surface of the base portion, the rear surface of the base portion defining a receiving recess communicating with the rear ends of the terminal grooves for receiving a holding cover therein, the receiving trough being located in front of the receiving recess and communicating with a bottom portion of the receiving recess; and a plurality of terminals each having a fixed portion and two shoulder portions projecting sideward from two opposite sides of one end of the fixed portion, when the terminals are assembled to the insulating housing, the shoulder portions are pushed forward by a tool to make the fixed portions insert into the terminal grooves and the shoulder portions be received in the receiving trough.

8. The electrical connector as claimed in claim 7, wherein the other end of the fixed portion has a contacting portion extending therefrom and received in the terminal groove, a free end of the contacting portion projecting out of the terminal groove for electrically contacting a complementary connector.

9. The electrical connector as claimed in claim 7, wherein two opposite sides of the holding cover respectively define at least one projecting thorn pressing against two opposing sides of the receiving recess for fixing the holding cover in the receiving recess.

10. The electrical connector as claimed in claim 7, wherein the end of the fixed portion of the terminal extends to form an extending portion, the extending portion being placed on a bottom side of the receiving recess.

11. The electrical connector as claimed in claim 10, wherein a free end of the extending portion of the terminal is bent to form a welded portion, the rear surface of the base portion defining a plurality of fixing passageways extending substantially perpendicularly to the terminal grooves and the receiving recess and communicating the receiving recess for correspondingly fixing the welded portions of the terminals.

12. The electrical connector as claimed in claim 10, wherein the holding cover defines a plurality of holding channels for correspondingly receiving the extending portions of the terminals therein.

* * * * *